US006530255B1

(12) United States Patent
Usui et al.

(10) Patent No.: US 6,530,255 B1
(45) Date of Patent: Mar. 11, 2003

(54) FORMING PRESS APPARATUS

(75) Inventors: Toshiyuki Usui, Sayama (JP); Seiya Sasaki, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/642,188

(22) Filed: Aug. 18, 2000

(30) Foreign Application Priority Data

Aug. 23, 1999 (JP) ..... 11-235786

(51) Int. Cl.[7] ..... B21D 28/24; B21D 43/05

(52) U.S. Cl. ..... 72/334; 72/294; 72/313; 72/404; 72/472

(58) Field of Search ..... 72/404, 472, 334, 72/335, 339, 338, 294, 312–315, 333, 336, 337, 405.01, 405.13, 405.16

(56) References Cited

U.S. PATENT DOCUMENTS

| | | | | | |
|---|---|---|---|---|---|
| 172,248 | A | * | 1/1876 | Chapman | 72/404 |
| 1,711,795 | A | * | 5/1929 | Kinney | 72/333 |
| 1,850,679 | A | * | 3/1932 | Leis | 72/337 |
| 1,884,476 | A | * | 10/1932 | Woodings | 72/472 |
| 2,070,784 | A | * | 2/1937 | Cox | 72/334 |
| 2,377,097 | A | * | 5/1945 | Norris | 72/404 |
| 2,989,936 | A | * | 6/1961 | Farnsworth et al. | 72/335 |
| 3,057,042 | A | * | 10/1962 | Lawson | 72/333 |
| 4,160,372 | A | * | 7/1979 | Bergman | 72/404 |
| 4,510,789 | A | * | 4/1985 | Tomioka | 72/472 |
| 4,550,588 | A | * | 11/1985 | Abe et al. | 72/404 |
| 4,559,804 | A | * | 12/1985 | Delio et al. | 72/404 |
| 4,625,540 | A | | 12/1986 | Yamada et al. | 72/421 |
| 5,054,353 | A | * | 10/1991 | Haack | 72/335 |
| 5,485,664 | A | * | 1/1996 | Huang | 72/404 |
| 5,813,271 | A | * | 9/1998 | Lee | 72/336 |

FOREIGN PATENT DOCUMENTS

| | | | | |
|---|---|---|---|---|
| JP | 165128 | * | 10/1982 | 72/312 |
| RU | 1246297 A | * | 10/1987 | 72/334 |

* cited by examiner

*Primary Examiner*—Daniel C. Crane
(74) *Attorney, Agent, or Firm*—Merchant & Gould P.C.

(57) ABSTRACT

A forming press apparatus with which forming of a plurality of different workpieces can be carried out using a single press. The press has raise/lowerable upper and lower die sets. A plurality of forming die pairs corresponding to a plurality of forming steps to be carried out on a pre-drawn workpiece are mounted en bloc to the die sets. The forming die pairs are disposed in a row on the die sets in the order of the forming steps.

4 Claims, 6 Drawing Sheets

FORMING PRESS APPARATUS

BACKGROUND OF THE INVENTION

1. Field of the Invention

This invention relates to a forming press apparatus for bending a trimmed workpiece.

2. Description of the Related Art

FIG. 7 hereof shows a typical vehicle body panel forming line of related art. This forming line is made up of three specialized machines: a drawing machine 100, a trimming machine 103 and a bending machine 106.

The drawing machine 100 has a drawing die pair 102 fitted to a press 101. The drawing die pair 102 consists of an upper die 102*a* and a lower die 102*b*. The trimming machine 103 has a trimming die pair 105 fitted to a press 104. The trimming die pair 105 consists of an upper die 105*a* and a lower die 105*b*. The bending machine 106 has a bending die pair 108 fitted to a press 107. The bending die pair 108 consists of an upper die 108*a* and a lower die 108*b*.

An example of forming a vehicle body panel with these specialized machines 100, 103 and 106 will now be described.

First, a blank is set in the drawing die pair 102 of the drawing machine 100. Then, the press 101 is operated and the blank is drawn. By this means, a drawn forming 110 is obtained.

Next, the drawn forming 110 is set in the trimming die pair 105 of the trimming machine 103. The press 104 is then operated and the edge 110*a* of the drawn forming 110 is trimmed off. By this means, a trimmed forming 111 is obtained.

The trimmed forming 111 is then set in the bending die pair 108 of the bending machine 106. The press 107 is then operated and bending is carried out on the edge 111*a* of the trimmed forming 111. By this means, a bent forming 112 is obtained.

Finally, various holes are made in the bent forming 112 to produce a vehicle body panel, and the vehicle body panel is assembled to a vehicle body on an assembly line.

In this way, a method has been typically employed wherein to manufacture a vehicle body panel at low cost wherein the vehicle body panel is mass-produced using three separate specialized machines like the drawing machine 100, the trimming machine 103 and the bending machine 106.

However, in recent years there has been a trend for car model changes to be made in relatively short cycles, and there has also been a change from the mass production of a few product types to the smaller-volume production of each of numerous product types. In the case of this high-variety, small-volume production, if three specialized machines like the drawing machine 100, the trimming machine 103 and the bending machine 106 are provided separately in a vehicle body panel forming line, the cost of the plant cannot be recovered and it is difficult for the cost of the vehicle body panel to be kept down.

In this connection, in U.S. Pat. No. 4,625,540 there is disclosed a press apparatus wherein a plurality of forming die pairs corresponding to a plurality of forming steps are mounted to a single press, and drawing is carried out at a first working station, piercing and finishing are carried out at a second working station, and trimming and splitting are carried out at a third working station.

However, when an upper/lower pair of dies for drawing are mounted in a row with other dies in the same press, because of the need to lay out cushion pins and the like for carrying out drawing from a flat sheet workpiece, inevitably the press itself becomes large.

And also, when a flat sheet workpiece is to be formed into a three-dimensional shape, because the forming load of the drawing step of the first working station is larger than the forming loads of the second and third working stations, the second and third working stations exert locally high loads. Consequently, the press as a whole becomes load-imbalanced, and the overall balance of the press may not be optimal for carrying out pressing in one shot.

SUMMARY OF THE INVENTION

It is therefore an object of the present invention to provide a forming press apparatus with which product cost can be kept down; which is not overly large; and which as a whole does not become load-imbalanced during pressing.

To achieve this and other objects, the invention provides a press apparatus for manufacturing a forming by press-forming a workpiece in a plurality of successive forming steps, which comprises a single press and die sets mounted raise/lowerably to the press and carrying en bloc a plurality of forming die pairs corresponding to the plurality of forming steps, wherein the plurality of forming die pairs include a primary forming die pair and a secondary forming die pair so that the plurality of forming steps are carried out simultaneously.

A primary forming is carried out on a metal sheet workpiece with the primary forming die pair in one shot of the press, and then the workpiece is transferred to the secondary forming die pair and a primary forming and a secondary forming are carried out simultaneously in the next shot.

Preferably, the plurality of forming die pairs are disposed in a row on the die sets in the order of the forming steps.

Thus, in this invention, because a plurality of forming die pairs of differing types are provided en bloc on upper and lower die sets on a single press, only one press is required for the plurality of forming steps; a plurality of die pairs can be moved simultaneously; and forming of a plurality of different workpieces can be carried out at the same time. In particular, because the forming of workpieces is carried out after drawing, which involves a large forming load, even when simultaneous forming is carried out with a single press there is no load-imbalance, and a well-balanced load can be applied to the plurality of die pairs.

The plurality of die pairs may preferably include a trimming die pair for trimming a pre-drawn forming, a coarse bending die pair for carrying out coarse bending on the trimmed forming obtained, and a finish bending die pair for carrying out finish bending on the coarsely bent forming obtained.

The stroke necessary for a trimming die and the stroke necessary for a bending die sometimes differ. Because normally the stroke of a bending die is larger than that of a trimming die, when a trimming die and a bending die are mounted on a single press, sometimes the stroke necessary for the bending cannot be provided and the required bent forming cannot be obtained; in this invention, however, two die pairs, a coarse bending die pair and a finish bending die pair, are provided as the bending die pair. Consequently, coarse bending can be carried out on the trimmed forming with the coarse bending die pair, and finish bending can be carried out with the finish bending die pair on the coarsely bent forming obtained. As a result, the workpiece can be bent in two stages and the workpiece can be bent to the desired shape.

BRIEF DESCRIPTION OF THE DRAWINGS

A presently preferred embodiment of the invention will now be described in detail, by way of example only, with reference to the accompanying drawings, in which.

DETAILED DESCRIPTION OF THE PREFERRED EMBODIMENTS

The following description is merely exemplary in nature and is in no way intended to limit the invention, its application or uses.

Figure 1:
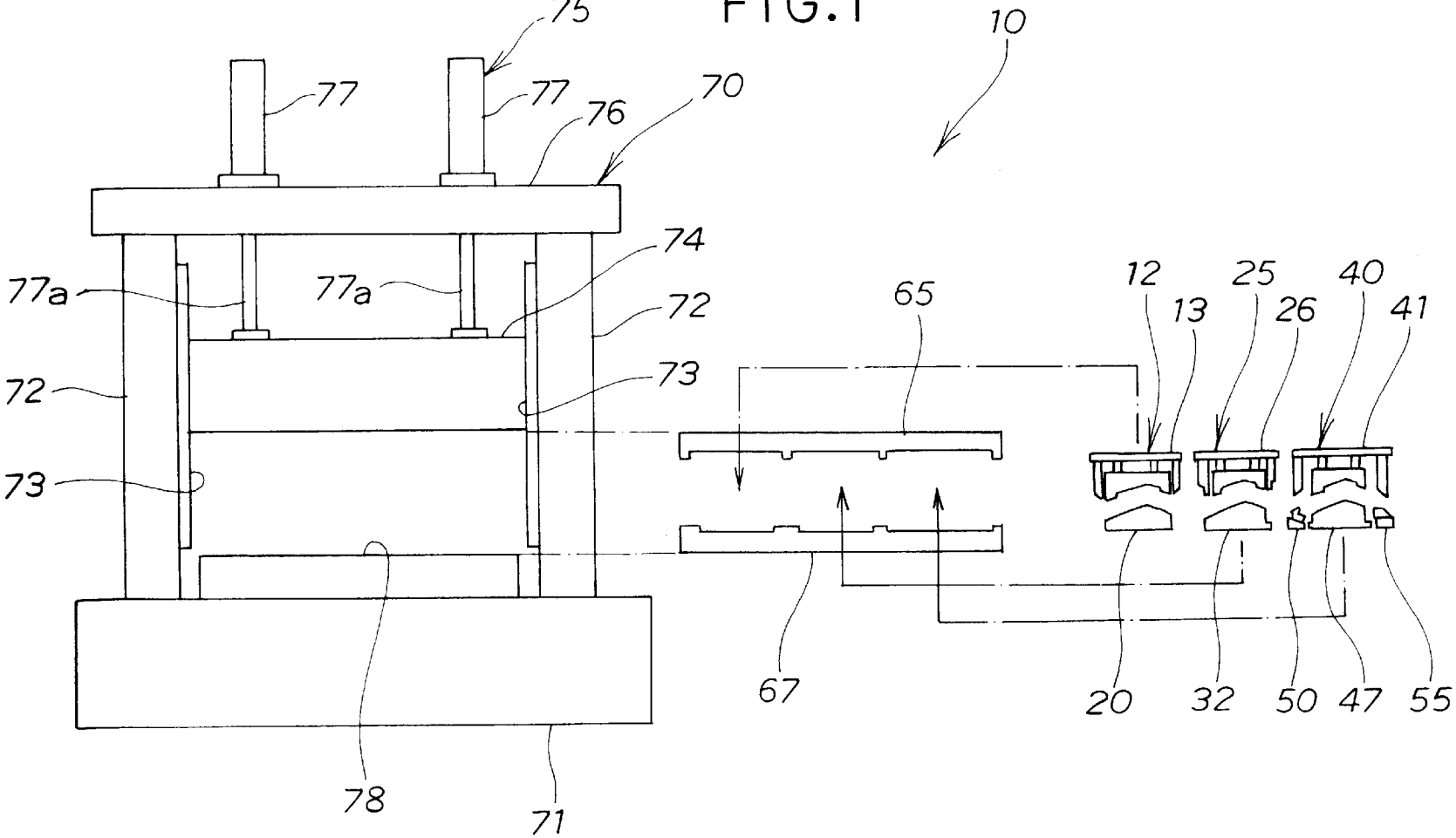
FIG. 1 is an exploded view of a forming press apparatus according to the invention.

In FIG. 1, a forming press apparatus 10 is made up of a primary forming die pair (trimming die pair) 12 for trimming a drawn forming; a secondary forming die pair (coarse bending die pair) 25 for coarsely bending a workpiece (trimmed forming) thus obtained; a finish bending die pair 40 for finish-bending a workpiece (coarsely bent forming) thus obtained; upper and lower die sets 65, 67 for carrying these die pairs 12, 25 and 40; and a single press 70, to which the upper and lower die sets 65, 67 are mounted and which moves the upper die set 65 toward the lower die set 67.

The trimming die pair 12, the coarse bending die pair 25 and the finish bending die pair 40 will now be described in detail with reference to FIG. 2.

An upper die 13 of the trimming die pair 12, an upper die 26 of the coarse bending die pair 25 and an upper die 41 of the finish bending die pair 40 are mounted en bloc to the upper die set 65.

A lower die 20 of the trimming die pair 12, a lower die 32 of the coarse bending die pair 25, a lower die 47 of the finish bending die pair 40, a finish bender 50 and a piercer 55 are mounted en bloc to the lower die set 67.

The press 70 has a base 71. The base 71 has a pair of columns 72, 72 mounted at its sides. The columns 72, 72 have guides 73, 73. A slider 74 is fitted between the guides 73, 73 so that it can be raised and lowered. Raising and lowering means 75 for raising and lowering the slider 74 is mounted on a bridge part 76.

The raising and lowering means 75 consists of pair of cylinders 77, 77 mounted on the bridge part 76. Rods 77*a*, 77*a* of the cylinders 77, 77 are connected to the slider 74.

Figure 2:
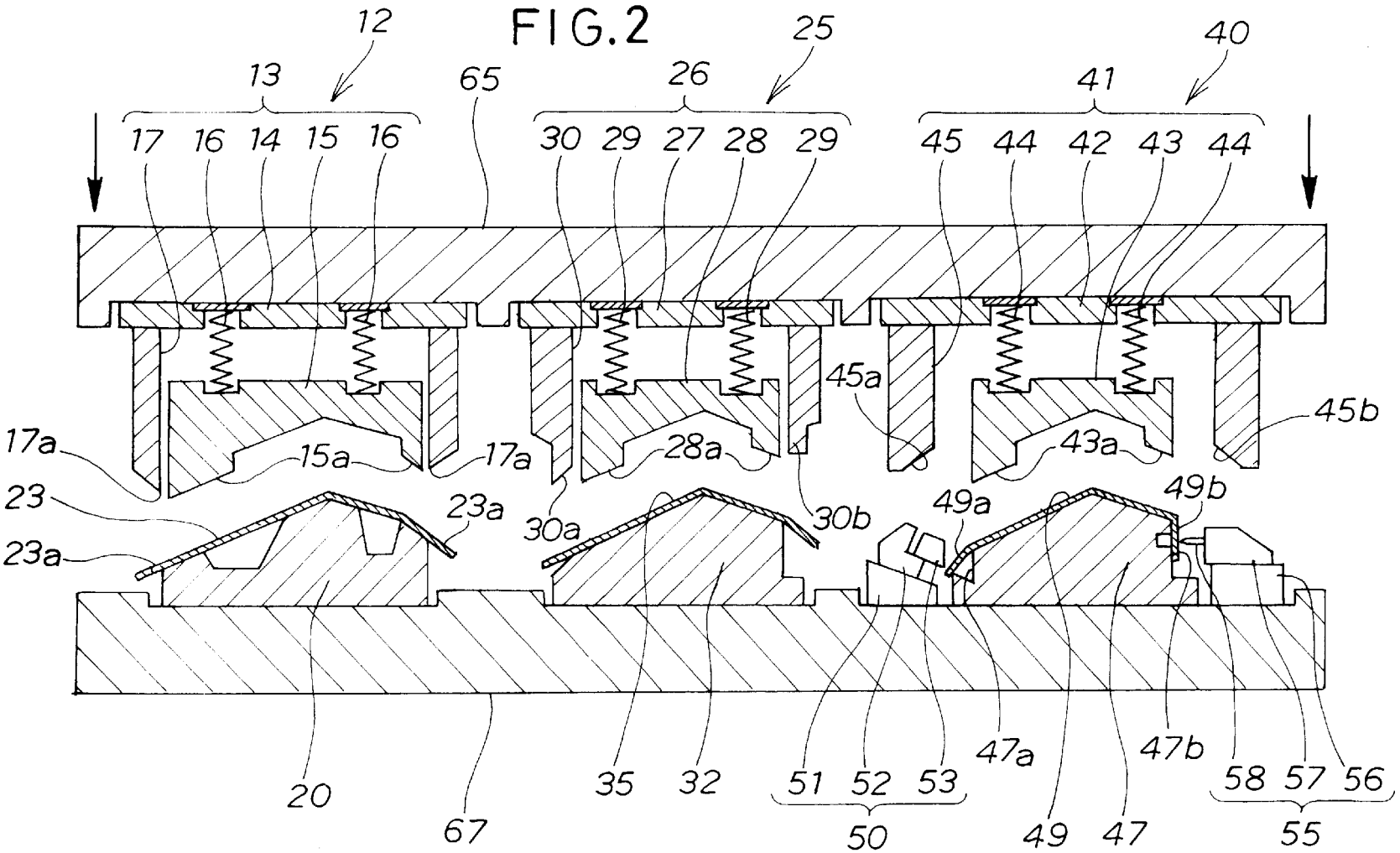
FIG. 2 is an enlarged sectional view showing a plurality of forming die pairs fitted to upper and lower die sets shown in FIG. 1.

FIG. 2 shows the trimming die pair 12, the coarse bending die pair 25 and the finish bending die pair 40 shown in FIG. 1 mounted to the upper and lower die sets 65, 67.

The trimming die pair 12 trims a drawn forming 23 set between the upper die 13 and the lower die 20, by the upper die 13 being lowered to the lower die 20.

The upper die 13 is made up of a holder 14 attached to the upper die set 65, a pressing pad 15 attached movably up and down to the holder 14, a plurality of pressing springs 16, 16 provided between the pressing pad 15 and the holder 14, and a cutter 17 disposed outward of the pressing pad 15.

The pressing pad 15 has around the periphery of its lower face a pressing face 15*a* for pressing the periphery of the drawn forming 23.

The pressing springs 16 press the pressing pad 15 against the drawn forming 23 while trimming of the edge 23*a* of the drawn forming 23 is carried out. The lower die 20 is attached to the lower die set 67; the drawn forming 23 is set on the lower die 20, and the lower die 20 trims the drawn forming 23 in cooperation with the upper die 13.

The coarse bending die pair 25 carries out coarse bending on a trimmed forming 35 set between the upper die 26 and the lower die 32, by the upper die 26 being lowered to the lower die 32.

The upper die 26 is made up of a holder 27 attached to the upper die set 65, a pressing pad 28 attached movably up and down to the holder 27, a plurality of pressing springs 29, 29 provided between the pressing pad 28 and the holder 27, and a coarse bend pressing die 30 disposed outward of the pressing pad 28.

The pressing pad 28 has around the periphery of its lower face a pressing face 28*a* for pressing on the periphery of the trimmed forming 35.

The pressing springs 29 press the pressing pad 28 against the trimmed forming 35 while coarse bending is being carried out on the trimmed forming 35.

The coarse bend pressing die 30 has at a left side lower face a sloping bend pressing surface 30*a* and has at a right side lower face a right angle bend pressing surface 30*b*.

The lower die 32 is attached to the lower die set 67; the trimmed forming 35 is set on the lower die 32, and the lower die 32 carries out coarse bending on the trimmed forming 35 in cooperation with the upper die 26.

The finish bending die pair 40 carries out finish bending with the finish bender 50 and hole-making with the piercer 55 on a coarsely bent forming 49 set between the upper die 41 and the lower die 47, by the upper die 41 being lowered to the lower die 47.

The upper die 41 is made up of a holder 42 attached to the upper die set 65, a pressing pad 43 attached movably up and down to the holder 42, a plurality of springs 44, 44 provided between the pressing pad 43 and the holder 42, and a finish bend pressing die 45 disposed on outward of the pressing pad 43.

The pressing 43 has around the periphery of its lower face a pressing face 43*a* for pressing on the periphery of the coarsely bent forming 49.

The springs 44 press the pressing pad 43 against the coarsely bent forming 49 while finish bending and piercing are being carried out on the coarsely bent forming 49.

The finish bend pressing die 45 has at a left side lower face a first pressing surface 45*a* for actuating the finish bender 50, and has at a right side lower face a second pressing surface 45*b* for actuating the piercer 55.

The lower die 47 is attached to the lower die set 67, and the coarsely bent forming 49 is set on the lower die 47. This lower die 47 has a finish bending surface 47*a* for bending over a sloping bend face 49*a* of the coarsely bent forming 49 and has a piercing surface 47*b* for making holes in a right angle bend face 49*b* of the coarsely bent forming 49.

The finish bender 50 is made up of a guide 51 disposed on the left side of the lower die 47, a moving member 52 movable on the guide 51, and a finish bending blade 53 attached to an inner end of the moving member 52.

The piercer 55 is made up of a guide 56 disposed on the right side of the lower die 47, a moving member 57 movable on the guide 56, and a hole-making punch 58 attached to an inner side end of the moving member 57.

Figure 3:
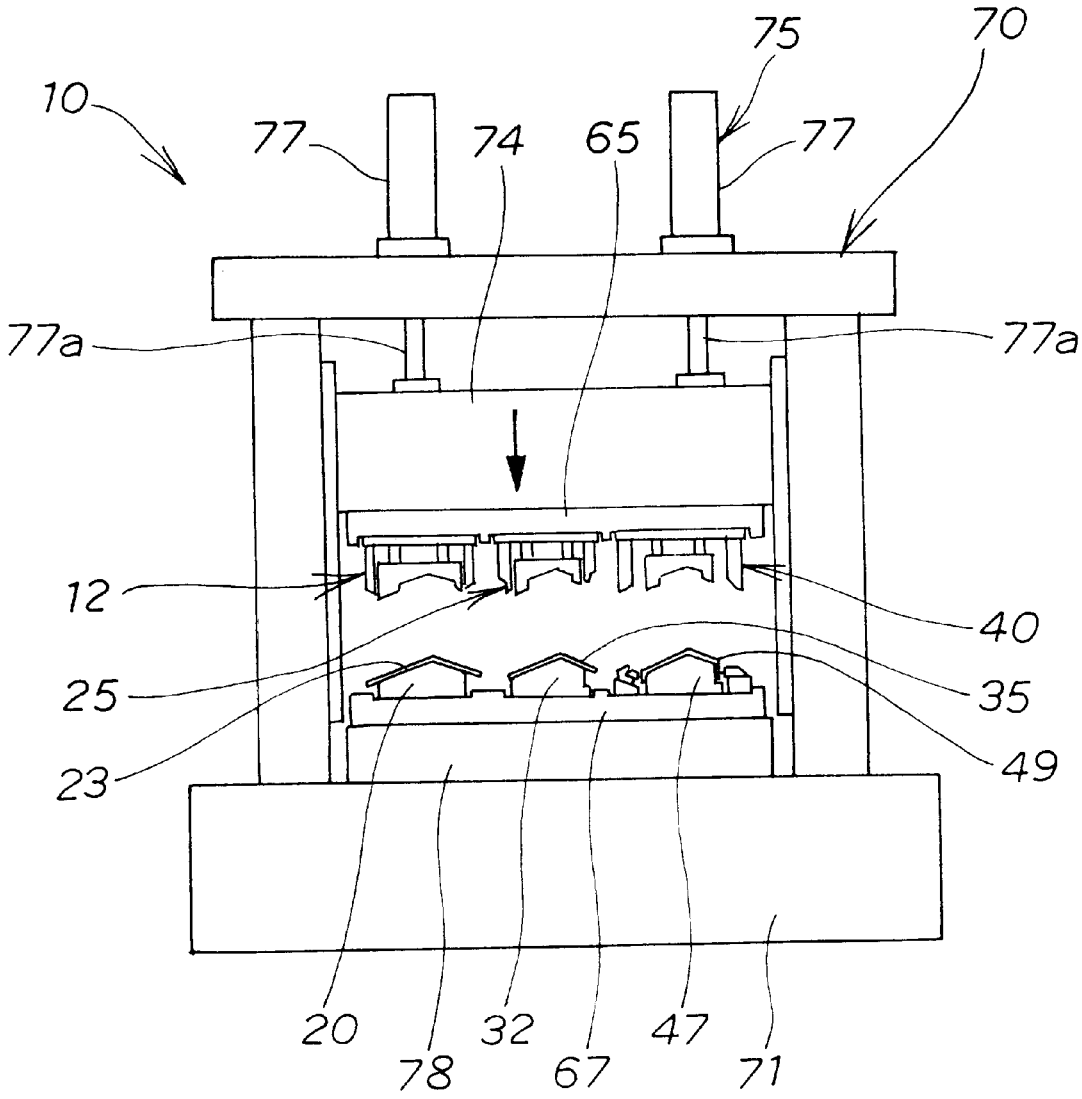
FIG. 3 is a side view of the forming press apparatus, showing the plurality of forming die pairs mounted by way of the die sets to a single press.

FIG. 3 shows the forming press apparatus 10 with the plurality of die pairs consisting of the trimming die pair 12, the coarse bending die pair 25 and the finish bending die pair 40 mounted en bloc on the upper and lower die sets 65, 67 and the upper and lower die sets 65, 67 mounted to the press 70.

In the press 10 of this preferred embodiment, first the drawn forming 23 is trimmed with the trimming die pair 12 in one shot of the press 70 and then the resulting trimmed forming 35 is transferred to the coarse bending die pair 25 and coarsely bent in the next shot; after that, the resulting coarsely bent forming 49 is transferred to the finish bending die pair 40 and finish bent in a further shot. In this way, a plurality of forming steps can be carried out with a single press 70. That is, the plurality of steps that are the trimming effected by the trimming die pair 12, the coarse bending effected by the coarse bending die pair 25 and the finish bending effected by the finish bending die pair 40 can be executed simultaneously.

The trimming die pair 12, the coarse bending die pair 25 and the finish bending die pair 40 are provided en bloc on a single press 70 by way of upper and lower die sets 65, 67. Consequently, only one press 70 is needed, and plant costs can be kept down. As a result, the cost of the product can be lowered.

Also, because the trimming die pair 12, the coarse bending die pair 25 and the finish bending die pair 40 can be controlled simultaneously just by controlling the single press 70, control can be made simple.

The operation of this forming press apparatus 10 will now be explained, on the basis of FIG. 2 through FIG. 5.

As explained above with reference to FIG. 3, as a result of a plurality of shots of the press 70 being made, a drawn forming 23 is set on the lower die 20 of the trimming die pair 12, a trimmed forming 35 is set on the lower die 32 of the coarse bending die pair 25, and a coarsely bent forming 49 is set on the lower die 47 of the finish bending die pair 40.

In this state, the raising and lowering means 75 of the press 70 is operated, and the slider 74 is thereby lowered. The upper die set 65 shown in FIG. 2 is lowered as shown with an arrow, and the upper die 13 of the trimming die pair 12, the upper die 26 of the coarse bending die pair 25 and the upper die 41 of the finish bending die pair 40 all descend simultaneously as shown in FIG. 4.

Figure 4:
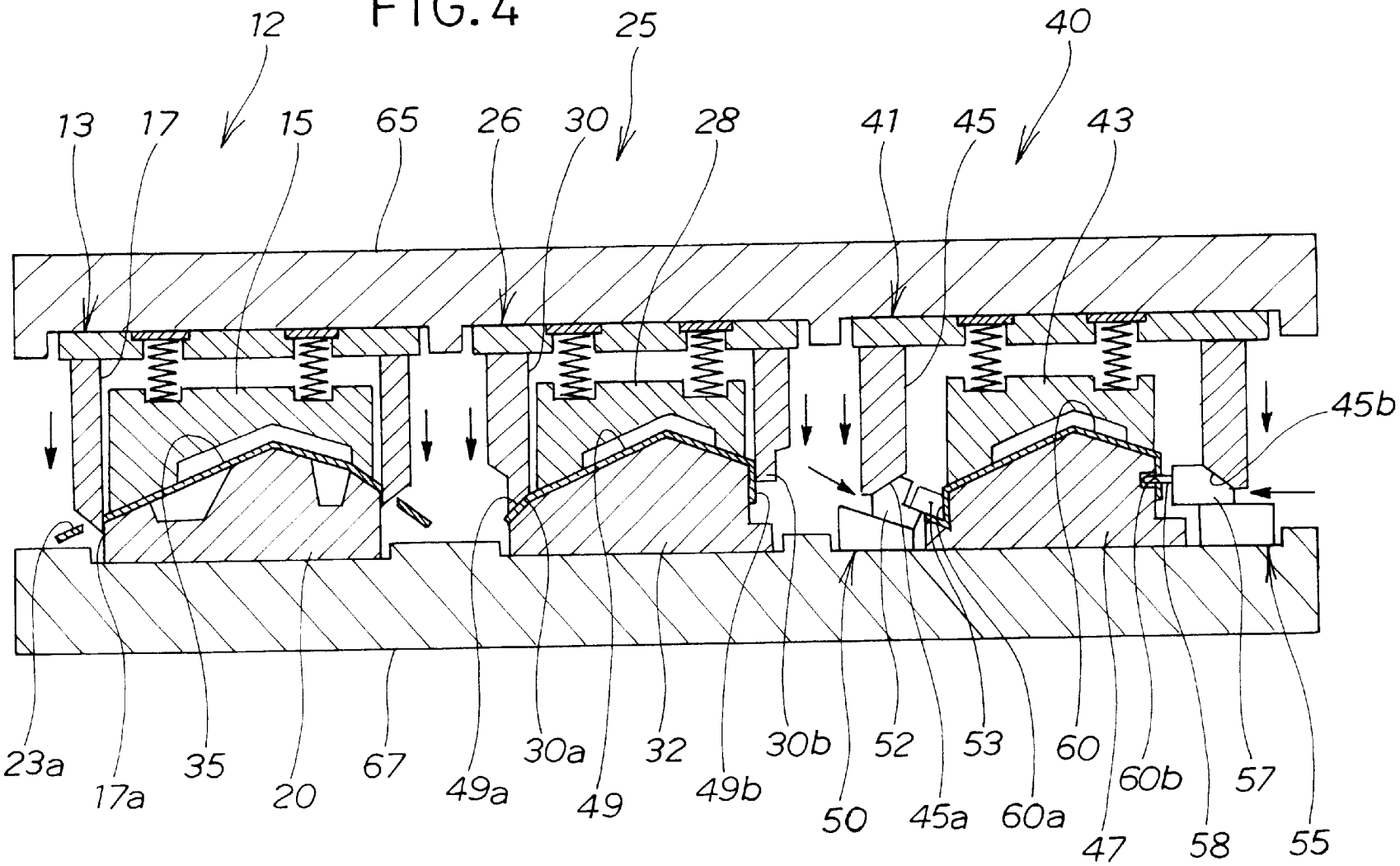
FIG. 4 is a sectional view, corresponding to FIG. 2, showing the upper die set lowered.
Figure 5:
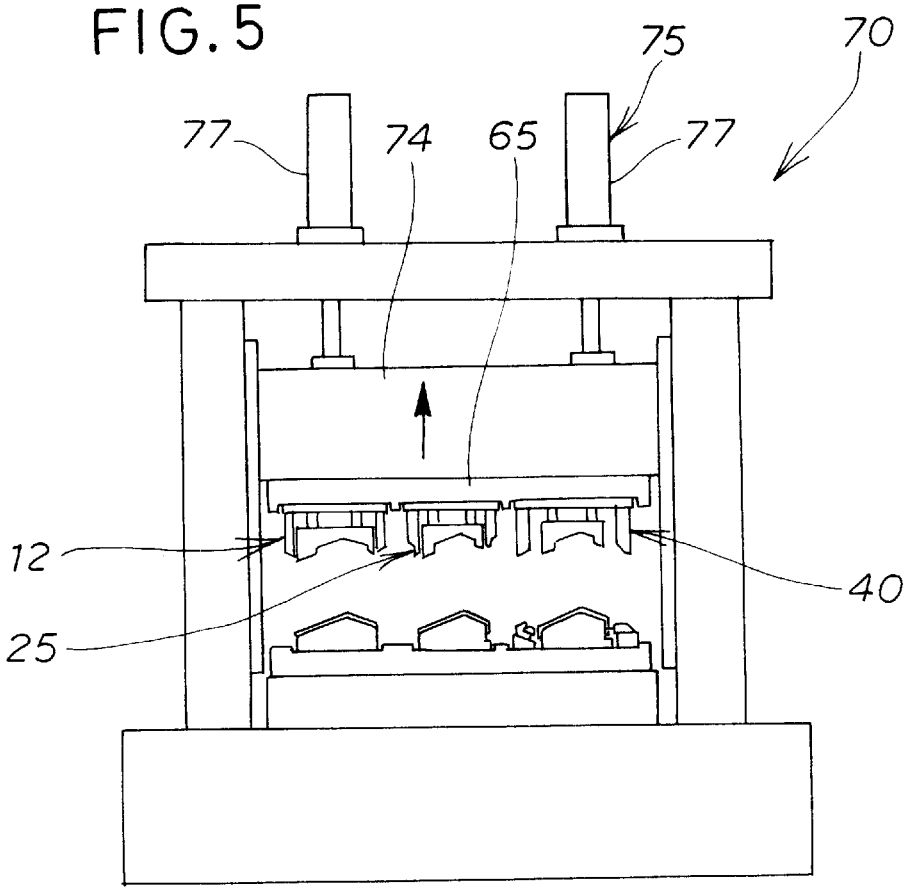
FIG. 5 is a side view of the forming press apparatus, corresponding to FIG. 3, showing the upper die set raised.

In FIG. 4, when the upper die 13 of the trimming die pair 12 descends, the drawn forming 23 shown in FIG. 2 is sandwiched between the pressing pad 15 and the lower die 20. And when from this state the upper die set 65 is lowered further, only the cutter 17 descends further, as shown with arrows, and the edge 23*a* of the drawn forming 23 is trimmed by a blade part 17*a* of the cutter 17, and a trimmed forming 35 is obtained.

At the same time, when the upper die 26 of the coarse bending die pair 25 descends, the trimmed forming 35 is sandwiched between the pressing pad 28 and the lower die 32, as shown in FIG. 2. And when from this state the upper die set 65 descends further, only the coarse bend pressing die 30 descends further, as shown with arrows. As it does so, a left side peripheral part of the trimmed forming 35 is bent by the sloping bend pressing surface 30*a* of the coarse bend pressing die 30 to form the sloping bend face 49*a*, and at the same time a right side peripheral part of the trimmed forming 35 is bent through a right angle by the right angle bend pressing surface 30*b* of the coarse bend pressing die 30 to form the right angle bend face 49*b*, whereby a coarsely bent forming 49 is obtained.

And also at the same time, when the upper die 41 of the finish bending die pair 40 descends, the coarsely bent forming 49 shown in FIG. 2 is sandwiched by the pressing pad 43 and the lower die 47. When from this state the upper die set 65 descends further, only the finish bend pressing die 45 descends further, as shown with arrows. As it does so, the first pressing surface 45*a* of the finish bend pressing die 45 presses on the moving member 52 of the finish bender 50. The moving member 52 is thereby moved inward toward the side face of the lower die 47, as shown with an arrow, and the finish bending blade 53 forms a finish bent edge 60*a*. At the same time, the second pressing surface 45*b* of the finish bend pressing die 45 presses on the moving member 57 of the piercer 55. The moving member 57 is thereby moved inward toward the lower die 47, as shown with an arrow, and the punch 58 makes a hole 60*b* in the right angle bend face 49*b*, whereby finished workpiece (finish bent forming) 60 is obtained.

Thus, in this preferred embodiment, two die pair sets, the coarse bending die pair 25 and the finish bending die pair 40, are provided as the bending die pair. The coarse bending die pair 25 performs coarse bending of the trimmed forming 35, and the finish bending die pair 40 performs finish bending of the coarsely bent forming 49 obtained. And these two stages of bending can be carried out simultaneously.

After the trimming, coarse bending and finish bending effected by one descent of the upper die set 65 have been carried out as described above, as shown in FIG. 5 the raising and lowering means 75 of the press 70 is operated and the upper die set 65 is lifted, as shown with an arrow, along with the slider 74.

Figure 6:
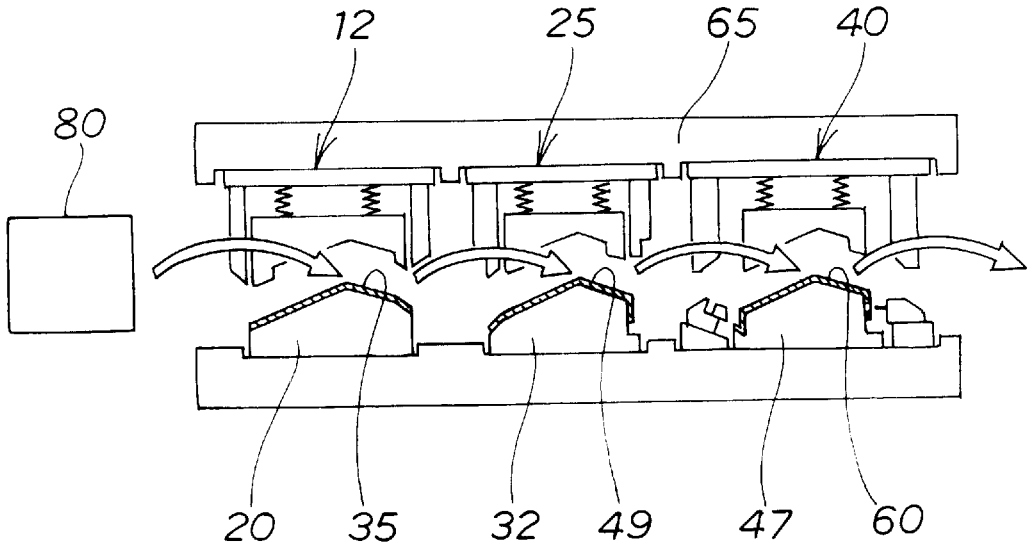
FIG. 6 is a view illustrating how workpieces are press-formed and then transferred to the die pair of the next step.
Figure 7:
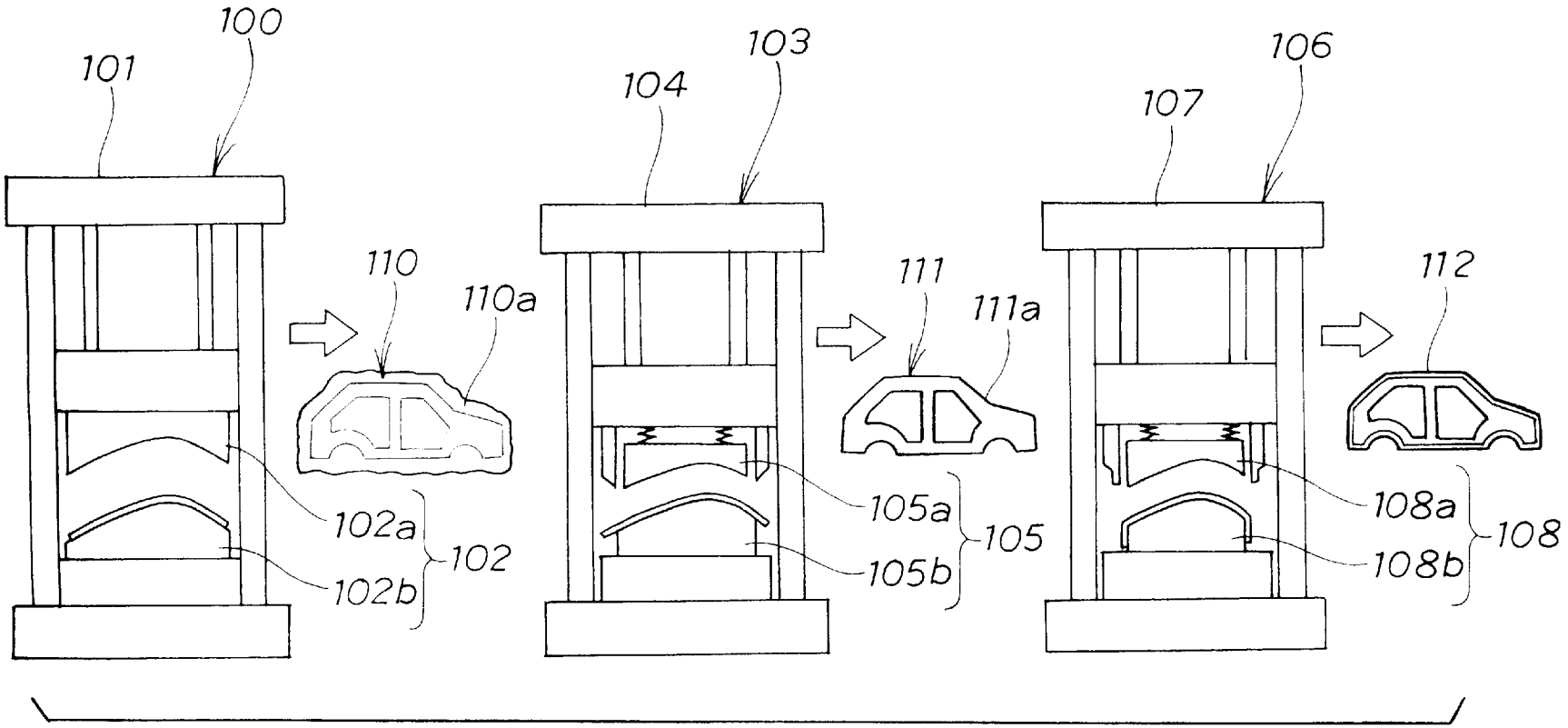
FIG. 7 (PRIOR ART)
FIG. 7 is a schematic view of a vehicle body panel forming line of related art.

As shown in FIG. 6, after the upper die set 65 is lifted, the finish bent forming 60 is taken from the lower die 47 of the finish bending die pair 40, as shown with an arrow. The finish bent forming 60 thus taken out is then carried to a subsequent step. The coarsely bent forming 49 is transferred from the lower die 32 of the coarse bending die pair 25 to the lower die 47 of the finish bending die pair 40, as shown with an arrow. And the trimmed forming 35 is transferred as shown with an arrow from the lower die 20 of the trimming die pair 12 to the lower die 32 of the coarse bending die pair 25. Then, a drawn forming 23 of the kind shown in FIG. 2 is transferred from a drawing die pair 80 as shown with an arrow to the lower die 20 of the trimming die pair 12. Thereafter, workpieces are processed continuously by the steps described above being repeated in order.

The transferring of the formings can be carried out for example by transfer robots having suction cups. Or the formings can be transferred by hand.

Although in this preferred embodiment an example wherein cylinders are used as the raising and lowering means 75 has been described, the invention is not limited to this, and alternatively for example the rods 77*a*, 77*a* may be attached to a crankshaft and the crankshaft rotated by a rotational drive source to raise and lower the rods 77*a*, 77*a*.

Obviously, various minor changes and modifications of the present invention are possible in the light of the above teaching. It is therefore to be understood that within the scope of the appended claims the invention may be practiced otherwise than as specifically described.

What is claimed is:

1. A forming press apparatus for manufacturing a forming by press-forming a pre-drawn workpiece in a plurality of successive forming steps, comprising:

a single press;

upper and lower die sets mounted to the press and carrying en bloc a plurality of forming die pairs corresponding to the plurality of forming steps, the plurality of forming die pairs including a trimming die pair for trimming a pre-drawn forming, a coarse bending die pair for carrying out coarse bending on a trimmed forming thus obtained, and a finish bending die pair for carrying out finish bending on a coarsely bent forming thus obtained, so that the plurality of forming steps can be carried out simultaneously, each of the forming die pairs having a spring-biased pressing pad for holding the pre-drawn workpiece while a corresponding one of the forming steps is carried out, the plurality of forming die pairs being disposed on the die sets in the order of the forming steps, each of the forming die pairs having an upper die with a pressing surface and a lower die; and a moving member mounted on the lower die set wherein said pressing surface presses on said moving member and said moving member thereby moves inward toward the lower die to further form the workpiece.

2. A method of forming a press-formed product having a three-dimensional shape from a flat sheet metal through successive different forming processes including drawing, comprising:

the drawing process is carried out on the flat sheet metal with a first forming press, thereby forming a drawn intermediate product, and thereafter, the forming processes other than the drawing process are carried out simultaneously with a second forming press, being different from the first forming press, in such a manner that the drawn intermediate product is used as a material for a first process of the forming processes other than the drawing process, and a formed product of the first process is used as a material for a second forming process of the forming processes other than the drawing process, wherein the first and second forming presses are operable independently from each other, and during the forming processes other than the drawing process, the formed product of the first process and a formed product of the second forming process are transferred separately to the second forming process and a third forming process of the forming processes other than the drawing process, respectively.

3. The method as defined in claim 2, wherein the forming processes include a trimming process for trimming the drawn intermediate product to thereby form a trimmed intermediate product, and a bending process for bending the trimmed intermediate product to thereby form a final press-formed product.

4. The method as defined in claim 3, wherein the bending process is a two-stage bending process comprised of a coarse bending process and a finished bending process carried out in the order named.

* * * * *